United States Patent [19]

Hirvonen et al.

[11] Patent Number: 4,907,281

[45] Date of Patent: Mar. 6, 1990

[54] METHOD OF IMAGE ANALYSIS IN PULVERIZED FUEL COMBUSTION

[75] Inventors: Juhani Hirvonen, Helsinki; Pekka Kohola, Espoo; Marja Apajalahti, Espoo; Mikko Höynänmaa, Espoo; Olli Otava, Klaukkala; Kristian Moring, Helsinki; Timo Hanioja, Vantaa, all of Finland

[73] Assignee: Imatran Voima Oy, Helsinki, Finland

[21] Appl. No.: 205,328

[22] PCT Filed: Oct. 16, 1987

[86] PCT No.: PCT/FI87/00137

§ 371 Date: Jun. 14, 1988

§ 102(e) Date: Jun. 14, 1988

[87] PCT Pub. No.: WO88/02891

PCT Pub. Date: Apr. 21, 1988

[30] Foreign Application Priority Data

Oct. 16, 1986 [FI] Finland ..... 864194

[51] Int. Cl.[4] ..... G06K 9/00

[52] U.S. Cl. ..... 382/1; 382/22; 340/577; 250/554

[58] Field of Search ..... 250/554; 340/577, 578; 328/6; 382/1, 22; 244/3.16; 110/185, 186, 187; 266/78, 86; 75/241, 242; 364/431.04, 431.05, 431.03

[56] References Cited

U.S. PATENT DOCUMENTS 4,396,903 8/1983 Habicht et al. ..... 382/22
4,555,800 11/1985 Nishikawa et al. ..... 340/577
4,561,104 12/1985 Martin ..... 382/22

*Primary Examiner*—Leo H. Boudreau
*Assistant Examiner*—Daniel Santos
*Attorney, Agent, or Firm*—Birch, Stewart, Kolasch & Birch

[57] ABSTRACT

An image processing method for flame monitoring is based on the formation of a video signal characteristic to the combustion process. In accordance with the method, the flame is monitored by each fire-box camera essentially from its side, whereby the video signal is adapted to cover at least an entire ignition area of a single burner, the video signal is continually processed to define the average intensity level corresponding to the steepest intensity gradients, and for each averaged level, the corresponding spatial or time coordinates of the continuous video signal, which define the location of the ignition area, are determined. The method extracts from the ignition and combustion process abundant information helpful in the control of combustion.

6 Claims, 3 Drawing Sheets

METHOD OF IMAGE ANALYSIS IN PULVERIZED FUEL COMBUSTION

The present invention relates to an image analysis method for flame monitoring for controlling the combustion of pulverized fuel.

BACKGROUND OF THE INVENTION

Pulverized fuel combustion implies a method in which the fuel, i.e., coal in conventional combustion but also peat to an increasing extent, is milled into a very fine-grained dust, which is then blown to the boiler via a nozzle using stack flue gas or air as the carrier. In coal- and peat-fired power plants, pulverized fuel combustion is a common method of combustion which inherently merits an extremely high value to improvements in the ignition and combustion of pulverized fuel.

Monitoring of the combustion process is availed to reduce the proportion of expensive auxiliary fuels. The monitoring operation is implemented in several ways, of which optical flame detectors are gaining ground thanks to the large information available from them.

A conventional method of monitoring combustion in a burner is to use a video camera, often called a fire-box camera. The video camera that produces a black-and-white or color video signal is located in a heat-resistant and cooled protective tube. In addition to air cooling, some cameras are provided with water cooling. The camera installations are generally provided with an automatic protection that ejects the camera out from the fire-box when a system malfunction is encountered.

Furthermore, flame monitoring is implemented with pyrometers sensitive to radiation intensity as well as with other types of detectors tuned to a narrow band of wavelengths. The quality of the combustion process is evaluated on the basis of flame instability (from the "DC" and "AC" components of flame intensity). A more advanced version of the aforementioned method is the cross-correlation method, also called the incremental volume method.

Use of a camera in the conventional methods is restricted to the monitoring of the averaged combustion process. The operation of a single burner can be monitored only at the ignition of the first flames and the extinction of the last flames. Detectors of the pyrometer category are hampered by such factors as placement and alignment of the detector, low temperature of the flame, etc. Some types of detectors are prone to erroneous response to nearby flames and background radiation from the walls of the fire-box. A disadvantage of the cross-correlation method is, for instance, its high sensitivity to changes in burning rate.

SUMMARY OF THE INVENTION

The aim of the present invention is to overcome the disadvantages of the prior art technology and to provide a totally new kind of monitoring system for the ignition and combustion of pulverized fuel including a flame monitoring system which is integral with the boiler's protective system and conforms to regulations issued by authorities. The invention is based on monitoring the ignition and combustion process over a large area by means of a video camera and on the localization of the ignition area by the identification of the average intensity level corresponding to the maximum intensity changes on selected lines of the video signal, after which the space coordinates corresponding to this intensity level in the complete video frame signal are determined.

More specifically, the method in accordance with the invention is characterized by aligning each fire-box camera to see the flame essentially from the side, repetitively processing the video signal to average intensity levels and determining the spatial or temporal coordinates of the continuous video signal.

The invention provides outstanding benefits.

The method in accordance with the invention provides high reliability because the combustion process is analyzed over a large area. Furthermore, the method can be adapted to accept a predefined permissible ignition area. Moreover, the method is compliant with different ignition and combustion conditions. Thanks to the compliancy of the method, the number of false alarms can be appreciably reduced. In accordance with the invention, a common analyzing apparatus can be adapted to serve for several cameras, thereby reducing equipment costs per burner. The method can be complemented with fault diagnostics, which allows for a higher reliability to be embedded into the system construction. Because information is readily available on the quality of combustion and ignition, the quantity of expensive auxiliary fuels can be reduced and the quality of combustion improved. The additional information obtained from combustion allows a higher efficiency of the boiler to be achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Next, the invention is examined in detail with help of the following exemplifying embodiment according to the attached drawings, which are given by way of illustration only, and thus are not limitative of the present invention, and wherein.

Figure 1A:
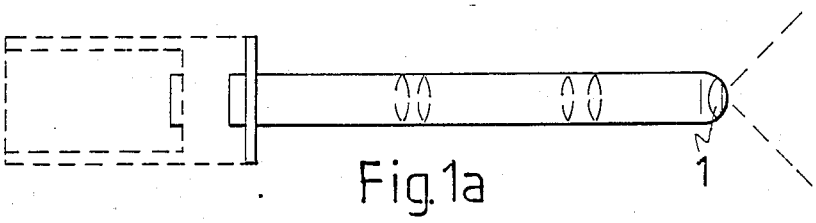
FIGS. 1*a*...1*c* show different types of fire-box cameras in cross-sectional side views.
Figure 1B:
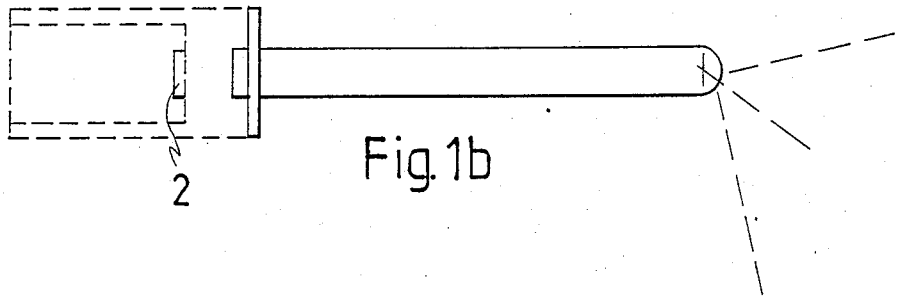
Figure 1C:
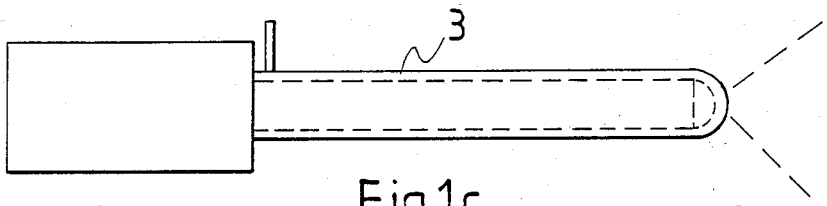

A fire-box camera, e.g., such a camera illustrated in Figures 1*a*...1*c*, can be used for investigating the ignition process of pulverized-fuel combustion. In its typical configuration, the camera comprises an optics system 1, a protective tube 3, and a photosensitive element, such as a solid-state matrix sensor 2 shown in this embodiment. The photosensitive component could also be a camera tube, but particularly in conjunction with pulverized fuel combustion, a solid state matrix camera is more applicable because the photosensitive area of this kind of a sensor is fully erased during the frame scan thus allowing an uncorrupted difference between successive frames to be extracted. Recently, a remarkable reduction in the size of solid-state cameras has occurred. In. principle, this facilitates the placement of the camera to the tip of the protective tube 3 provided that the problems associated with cooling can be solved. Furthermore, the camera could conceivably be located in a tilted position thus providing a more appropriate view into a greater number of fire-box types than is possible with the currently used perpendicular alignment. The tests were performed using a solid-state camera with bandpass filters for appropriate wavelength areas mounted in front of it.

Figure 2:
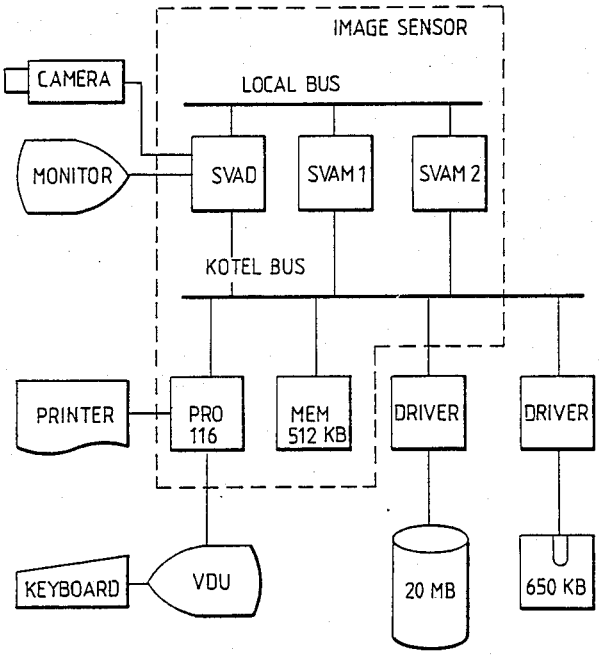
FIG. 2 shows schematically an image analysis system in accordance with the invention.

FIG. 2 illustrates the image analysis equipment used in the performed tests. Conventional technology is used in the equipment. A standard video signal of the fire-box camera (solid-state camera) is routed via a selector to analog/digital converters. By way of the selector, the equipment can serve several cameras. The A/D conversion used in the equipment results in a 6-bit digital signal corresponding to 64 gray scale steps in the video picture. The video frame is stored in an image memory, which in the described equipment has a size of 256×256 pixels (picture elements). Hence, each frame consists of 256 lines, and each line comprises 256 pixels, whose numerically quantized intensity values may vary in the range of 0...63, according to the pixel intensity value. The equipment has two identical image memories; the image can be stored in either memory, but this application uses image memory SVAM 1 for image input and image memory SVAM 2 for output processed information. The image stored in the image memory is printed via color translation tables, which assign a desired color from a preset palette of colors to each of the 64 gray levels. The image is shown in the standard video signal format on a color monitor, conventionally through the R (red), G (green), and B (blue) video outputs.

On the other hand, the image memories are configured to form a part of the processing equipment memory space so that the CPU can read and write pixels in the image memory. The depth of image memories is 8 bits making 256 hues to be available at the output although the input signal is only in a 6-bit format. The benefit of using 8 bits is that four frames from the camera can be summed (under program control) into the image memory without overflow.

The mass memories of the equipment comprise Winchester and floppy-disk type drives serving as mass memories, a real-time operating system, Pascal and PL/M compilers, which combination permits concurrent digital image processing with the development and testing of different kinds of algorithms.

Figure 4:
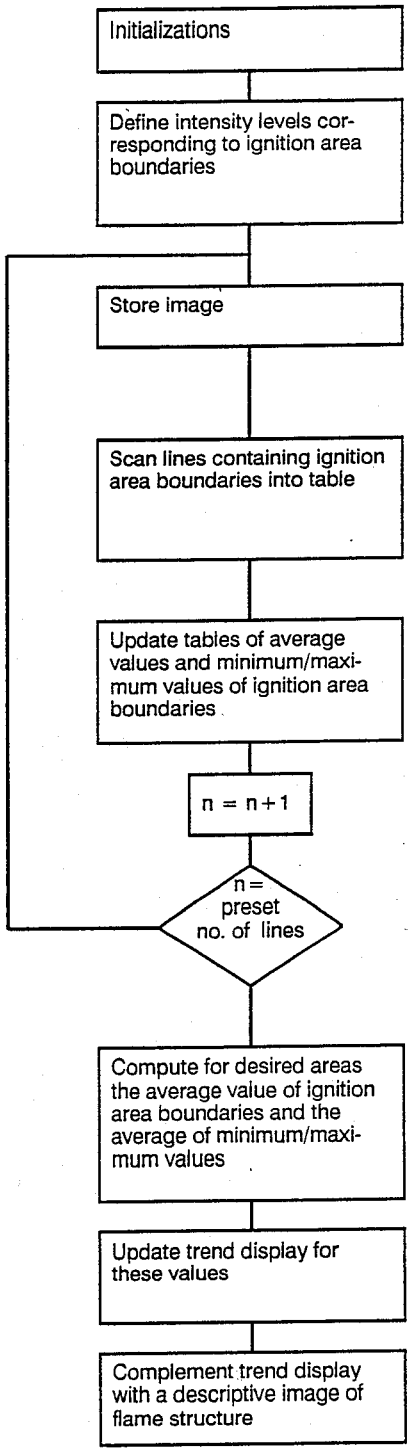
FIG. 4 shows a flow chart for the structure of a computer program executing the method in accordance with the invention.

In the following, the outline of program functions is given. It must be understood that the version illustrated is simply one possible embodiment of the solutions offered by the invention. In FIG. 4, the actual image analysis program is shown in flow diagram form.

Image analysis proceeds principally line-by-line either starting from left to right or vice versa, depending on the location of the burner nozzle in the image, i.e., if the nozzle is closer to right margin, the lines are read from right to left.

When the program execution is started, the program requests the user for the following basic information:

Line numbers of top and bottom lines outlining the image area to be processed. The aim is not to process the whole video frame because the flame to be analyzed does not fill the entire image. Naturally, this procedure speeds image processing.

A value for coefficient (k), which controls the image "jitter" at the ignition area boundaries, and thereby variations in the averaged ignition area shown on the trend display.

A value for coefficient (b), which is related to the smoothing of minimum and maximum values of ignition area boundaries.

Furthermore, the trend display update interval can be defined in either terms of time or given number of processed images after which the display is updated.

In addition, information on the sidedness of the nozzle, or the side from which picture processing is to be commenced, can be given to the program.

Among other things, the aforementioned variables and tables are loaded with preset values at the initialization stage.

The tables used in the program are as follows:

LTable, HTable, HMean, LMin, and HMax, each with a size of 256*2bytes. The size of trend tables TrMean, TrMin, and TrMax is selected to be sufficiently large for possible storage of historical information that does not fit onto the display. When required, this information is then readily available. The memory contents of all tables are cleared, except for tables LMean, HMean, LMin, and HMax, which are used for computation of averaged values over a longer period. The aim is to initially load these tables with initial values that are as close as possible to the boundaries of the expected ignition area. This procedure reduces the time required for the trend display to settle to its actual value.

In order to find the ignition area, an image is analyzed for four scan lines on which the gradient of pixel intensities is highest. This is implemented by counting from the start (or end) of the line the intensity value sum of three successive pixels which is then subtracted from the intensity value sum of next string of three pixels. The difference obtained is proportional to the intensity gradient. The line is subjected pixel by pixel to the routine described above. The sums obtained from two pixel strings rendering the highest differences are stored. The average of these pixel intensities is the desired boundary threshold for the processed line. When each of the four lines is processed for the highest pixel intensity gradient, the average value o these intensity levels is computed. The front and rear boundaries of the ignition area are then obtained by subtracting or adding a preset constant from or to the aforementioned average value, respectively.

Next, an image is stored for computation of ignition area boundaries. Starting from the beginning of a line, sums of intensity values of four successive pixels are computed. When the average computed from the sum exceeds the intensity threshold of the front boundary computed by way of the routine described in the foregoing, the front boundary is considered found. The (vertical) video matrix column at which the boundary was found is stored in the table LTable. The same line is further processed until the rear boundary is found. Equally, this boundary position is stored in its appropriate table HTable. To increase the speed of front boundary search, search is not commenced on the next line from the beginning but instead close to the position where the boundary was found on the preceding line.

The tables LTable and HTable mentioned above are used for the update of the tables LMean and HMean, into which the temporally averaged spatial coordinates of the front and rear boundaries are computed according to the formula:

$$LMean = k*LMean + (1-k)*LTable,$$

where k is the coefficient entered in the initialization routine with a range of $0<k<1$. Thus, the table LMean is updated line by line with new values which take into account ignition area information from the last recorded image, weighed in a desired manner. By increasing the value of the constant k, this procedure helps in smoothing the random variations of intensity values and results in a realistic indication of actual changes on the trend display. (An equivalent procedure is applied to the tables HMean and HTable associated with the intensity values of ignition area rear boundary).

Further, the variations of front boundary minimum values and rear boundary maximum values are monitored by gathering these values to their respective tables LMin and HMax. These tables are updated by the procedure described in the following. If the front boundary of a certain line in the latest stored image has been found spatially earlier than the value given by the table LMin for the corresponding line, the values on that row of the table are replaced by the values obtained from the line of the image, or expressed in a formula:

$$\text{if } LTable < LMin, \text{ then}$$

$$LMin = LTable.$$

Next, the value in the table LMin is gradually corrected so as to make it slowly approach the temporally averaged value of the ignition area front boundary. This is accomplished by the formula:

$$LMin = LMin + b*(LMean - LMin),$$

where b is the coefficient (with a Value $0<b<1$) described in the foregoing. The greater the value of coefficient b, the faster the minimum value in the table LMin approaches the value given in the table LMean.

Correspondingly, for the computation of the maximum value, the following formulas are applied:

$$\text{if } HTable > HMax, \text{ then}$$

$$HMax = HTable \text{ and}$$
$$HMax = HMax - b*(HMax - HMean).$$

Information described above is gathered and updated into the tables at about 5 s intervals, after which the combined averaged intensity value of all scan lines from the ignition area front and rear boundary tables is computed into a table TrMean. In addition, the average of all lines from the minimum value table is computed into a table TrMin, and the average of all lines from the maximum value table is computed into a table TrMaX, respectively. Information obtained in this manner is then shown together with the average, minimum, and maximum values on the trend display. The variation range between the minimum and maximum values is indicative of the instability of the flame, while their mutual distance characterizes the width of the ignition area.

Figure 3:
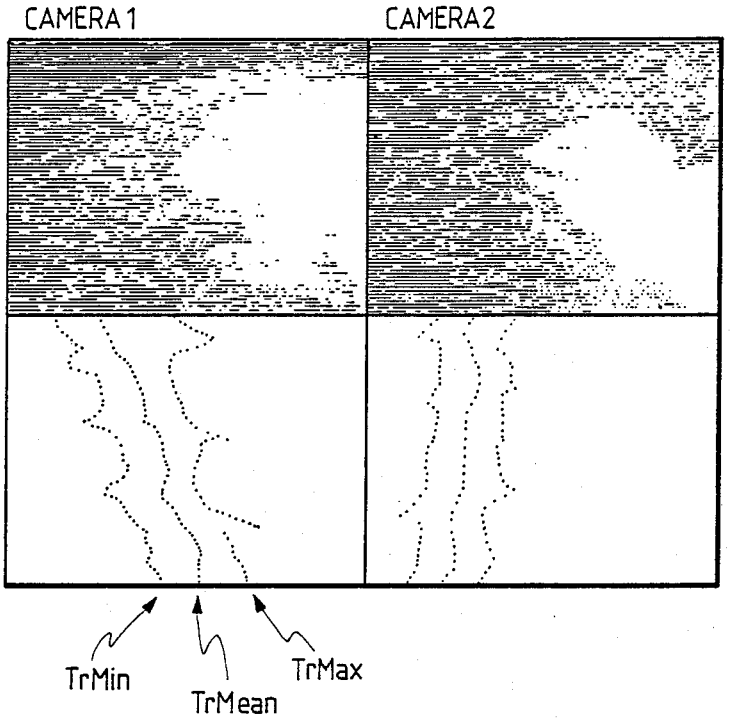
FIG. 3 shows a screen display layout in accordance with the invention.

After a four-fold update of the trend display, the current image of the flame is shown on the display in a modified color picture. The modified color display is accomplished by assigning different hues of blue varying from dark blue to light blue to the dark areas outside the ignition area boundary up to the boundary. At the boundary the color is changed to red, which changes towards the brighter areas of flame from dark red to light red, and finally, to white. A single screen can be used for simultaneous presentation of information from two different cameras as shown in, e.g., FIG. 3.

The method illustrated in the foregoing represents only one possible embodiment within the scope of the invention. The described methods can be applied to equipment different from those described above. It is also possible to solve the problem by using dedicated electronics for the identification of ignition area values. This approach disposes of image storage for the input image signal. The dedicated electronics integrates the video signal by lines and stores the addresses (or locations) where the video signal change exceeds the preset thresholds assigned to intensity values of the ignition area boundaries. The boundary locations (addresses) appropriately found on each line are sent by the electronics to the processor. An appreciable saving in time is obtained by way of this method.

Moreover, it is possible to construct a preprocessing unit that logs the intensity values from the entire image to the tables, after which tables are submitted to analysis. Extended electronics integration could provide the preprocessing electronics with a facility to compute in real time (i.e., by processing each frame of the video signal) the tables for the averaged ignition area values as well as for the fluctuations of the iqnition area. Thereby, the system could also provide for an extremely fast flame monitor. Then, the flame monitoring functions could be configured more reliable than those offered by a conventional flame monitor.

The image display can function well without an image memory and D/A converters. Due to the synthetic nature of the displayed picture, the computational results may be output to, e.g., a graphic terminal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image analysis method for flame monitoring, particularly a method for the determination of ignition area location and combustion in pulverized-fuel combustion, in which method at least one fire-box camera is used for generation of a continuous video signal illustrative of the combustion, from which signal an instantaneous image of the flame being monitored can be formed on a display device, the method comprising the steps of:

aligning each fire-box camera to see the flame essentially from the side so that the video signal is adapted to include the entire ignition area of at least one burner;

repetitively processing the video signal to determine the average intensity level corresponding to the steepest intensity gradients; and determining at least one of the spatial and temporal coordinates of the continuous video signal, defining the location of the ignition area and corresponding to each of the average intensity levels.

2. The method in accordance with claim 1 further comprising the step of using temporal changes in the ignition area location for control of the boiler.

3. The method in accordance with either of claims 1 or 2, in which method each video image is divided into subsequent picture elements, each assigned to a unique spatial and temporal value, the method further comprising the steps of processing adjacent picture elements into groups of picture elements in desired areas in order to eliminate random disturbance, forming differences of intensity values of the adjacent picture element groups, searching maximum values of the differences, and computing intensity averages for the picture element groups having the largest differences in order to determine threshold intensity levels for the ignition area.

4. The method in accordance with claim 3 in which method the video signal representing the image is divided into horizontal lines, the method further comprising the step of individually processing desired lines to find maximum values of intensity value differences.

5. The method in accordance with claim 3, further comprising the step of determining the boundaries of ignition areas by adding or subtracting an appropriate constant to or from the threshold intensity level.

6. The method in accordance with claim 1, further comprising the step of applying electronic means to integrate the video signal in order to reduce disturbance and to determine the spatial coordinates corresponding to maximum gradient values in order to locate the ignition area.

* * * * *